US006397855B1

(12) United States Patent
Dumler

(10) Patent No.: US 6,397,855 B1
(45) Date of Patent: Jun. 4, 2002

(54) MASCARA BRUSH

(75) Inventor: Norbert Dumler, Ansbach (DE)

(73) Assignee: Geroge Karl Geka-Brush GmbH, Bechhofen-Waizendorf (DE)

( * ) Notice: Subject to any disclaimer, the term of this patent is extended or adjusted under 35 U.S.C. 154(b) by 0 days.

(21) Appl. No.: 09/566,980

(22) Filed: May 9, 2000

(30) Foreign Application Priority Data

May 18, 1999 (DE) ..... 199 22 706

(51) Int. Cl.[7] ..... A45D 40/26; A45D 40/24; A46B 11/00

(52) U.S. Cl. ..... 132/218; 132/320; 132/317; 401/129; 401/122

(58) Field of Search ..... 132/218, 317, 132/318, 320, 313, 120; 401/129, 122, 128, 127; 15/184

(56) References Cited

U.S. PATENT DOCUMENTS

| | | | | | |
|---|---|---|---|---|---|
| 2,763,104 | A | | 9/1956 | Lindenborg | |
| 4,341,231 | A | * | 7/1982 | Costa | 132/218 |
| 4,365,642 | A | * | 12/1982 | Costa | 132/218 |
| 4,561,456 | A | * | 12/1985 | Gueret | 132/218 |
| 4,619,012 | A | | 10/1986 | Wachtel | |
| 5,133,590 | A | | 7/1992 | Fitjer | |
| 5,345,644 | A | * | 9/1994 | Gueret | 15/160 |
| 5,709,230 | A | * | 1/1998 | Miraglia | 132/218 |
| 5,862,812 | A | | 1/1999 | Dumler | |
| 6,073,634 | A | * | 6/2000 | Gueret | 132/218 |

FOREIGN PATENT DOCUMENTS

| | | |
|---|---|---|
| DE | 9316562 U | 3/1994 |
| DE | 19847733 | 10/1998 |
| EP | 0568400 A1 | 3/1993 |
| EP | 0717944 B1 | 12/1995 |

* cited by examiner

*Primary Examiner*—John J. Wilson
*Assistant Examiner*—Robyn Kieu Doan
(74) *Attorney, Agent, or Firm*—Browdy and Neimark, P.L.L.C.

(57) ABSTRACT

In a mascara brush comprising a plurality of bristles which are held between two intertwisted wire sections, it is provided, with a view to obtaining an optimal transfer effect, that at least part of the bristles form loops.

13 Claims, 1 Drawing Sheet

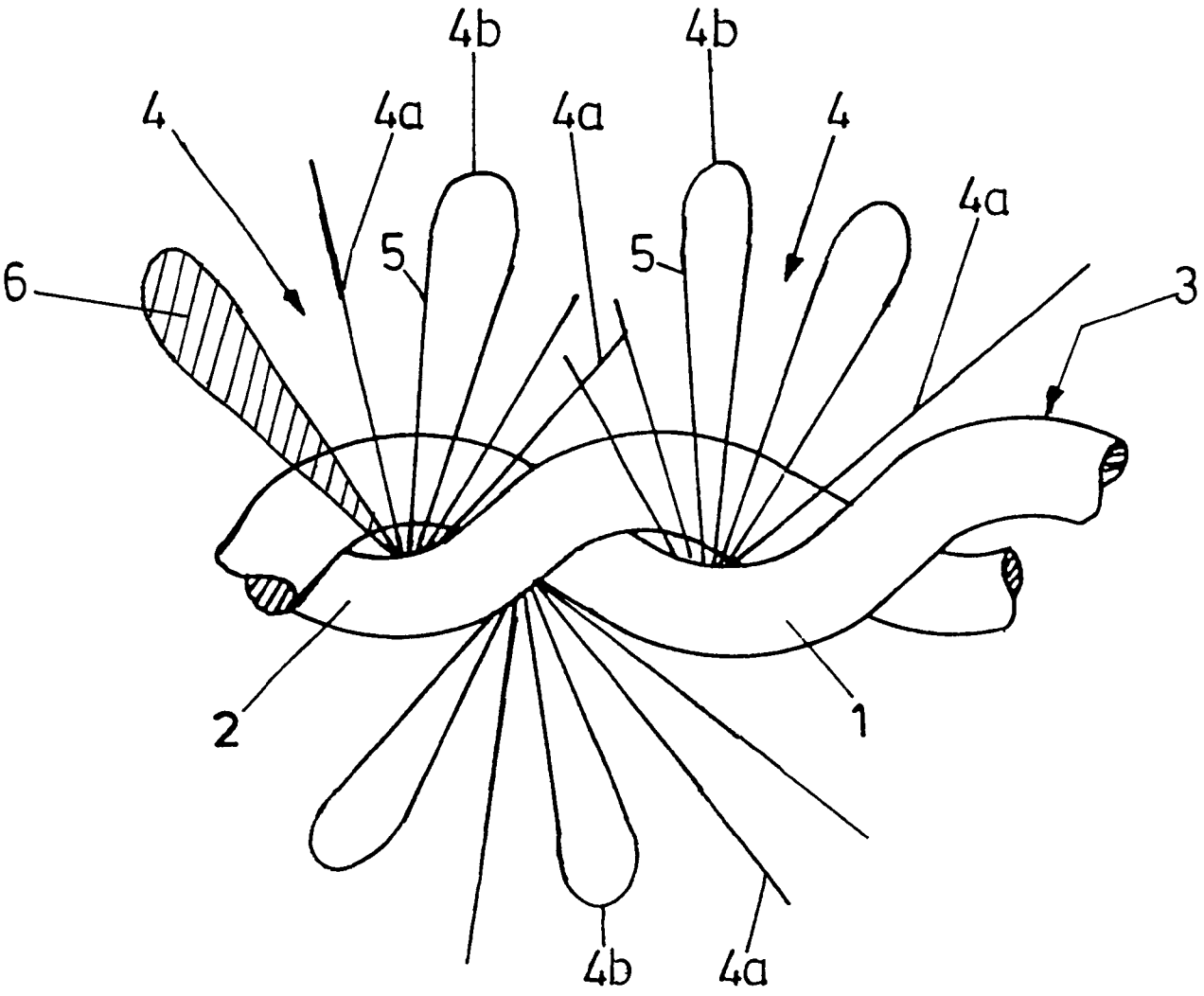
3
4a
4
4b
5
4a
4b
5
4a
4
6
1
4a
4b
2

MASCARA BRUSH

BACKGROUND OF THE INVENTION

1. Field of the Invention

The invention relates to a mascara brush comprising a plurality of bristles held between two intertwisted wire sections.

2. Background Art

Mascara brushes of the generic type serve to transfer mascara from a reservoir to the eyelashes of the user. When the mascara is applied by means of the brushes, it is important for them to have an excellent transfer capacity on the one hand and sufficient combing and separating properties on the other.

For optimization and individualization of the properties of mascara brushes of the generic type, it is known to use a variety of bristle materials or mixtures of varying bristles. European Patent 0 717 944 teaches mascara brushes in which the core constituted by the intertwisted wire sections is bent to form a loop. U.S. Pat. No. 5,133.590 describes a mascara brush with fibers which can be split by a bonding agent being dissolved out.

DE 198 47 733 A1 discloses a brush in which, on the convex side of the core, the envelope curve of the tips of the bristles, in a longitudinal section, has approximately the shape of a section of an arc of a circle and in which, on the concave side of the core, it is approximately linear at least along a section line.

U.S. Pat. No. 5,862,812 describes a mascara brush in which the bristles are trimmed so that, seen in a cross section, they are asymmetric in such a way that the bristles on one side stand out less from the intertwisted wire sections than they do on the other and that, seen in a longitudinal section, the bristles are trimmed asymmetrically so that they have varying lengths.

A brush is known from DE 93 16 562 U, in which the core of the brush constituted by the intertwisted wire sections is again intertwisted itself for a cylindrical inner cavity to form.

SUMMARY OF THE INVENTION

It is an object of the invention to embody a mascara brush of the type mentioned at the outset so that in particular an optimal transfer capacity is achieved, accompanied with a good combing effect.

This object is attained by at least part of the bristles forming loops. In other words, in such a brush there is no free end standing out externally, but it is also clamped between the wire sections so that a looped and closed configuration is produced. Due to the adhesion of the mascara liquid, a film forms in these loops when the brush is pulled out of the reservoir, filling the loops virtually completely; this film only breaks when contacting the lashes during application so that a comparatively great amount of mascara liquid is dispensed.

Preferably it is provided that a part of the bristles are looped and another part conventionally stands out in the radial direction. These bristles which stand out radially and the rigidity of which can be regulated by selection of their length and diameter help attain an optimal combing effect, whereas the bristles of looped configuration provide for optimization of the transfer properties.

In keeping with a further development of this embodiment, provision can be made in the longitudinal direction for sections which have loops and sections with bristles standing out radially. It is then possible for the user for example first to touch the lashes by the section provided with loops for the application of mascara and then to proceed with combing by the section of radially extending bristles.

By advantage provision is made for the radial length of the loops to differ from the length of the radially extending bristles. For instance, the length of the bristles which stand out radially can exceed the length of the loops so that an optimal combing effect is produced.

In keeping with another embodiment, the loops themselves are intertwisted, forming for instance a figure-eight configuration, whereby the surface of the loops is virtually adjustable.

It can further be provided that the plane spanned by the loops varies in inclination relative to the longitudinal axis defined by the intertwisted wires.

BRIEF DESCRIPTION OF THE DRAWING

Details of the invention will become apparent from the ensuing description of a preferred embodiment, taken in conjunction with the drawing, which is a perspective view of a detail of a mascara brush according to the invention.

DESCRIPTION OF THE PREFERRED EMBODIMENT

A mascara brush, details of which are seen in the drawing, comprises intertwisted wire sections 1, 2 which form a wire core 3.

Bristles 4 are fixed by the intertwisted wire sections 1, 2, a part 4*a* of the bristles 4 conventionally standing out radially and having a free end, whereas another part 4*b* of the bristles forms loops 5.

As roughly outlined by the hatched surface 6 on the left in the drawing, when such a brush is pulled out of a mascara reservoir, a film of mascara liquid is retained by reason of the surface tension within a loop 5 so that optimal transfer properties are obtained. By contrast, the linear bristles 4*a* of prolonged radial length serve to uniformly distribute the mascara liquid applied, i.e. they have sort of a combing effect, which also prevents lumping. The properties of a mascara brush according to the invention have an especially advantageous effect when the viscosity of the liquid to be applied ranges between 500 and 40,000 poises.

What is claimed is:

1. A mascara brush for insertion into a reservoir of mascara and transfer of mascara to eyelashes of a user, the mascara brush having a plurality of bristles which are held between two intertwisted wire sections, wherein the bristles have means for transferring and holding mascara from a reservoir for application on the eyelashes of the user, and wherein part of said means are loops (5) formed from at least part of the bristles (4).

2. A mascara brush according to claim 1, wherein a part (4*b*) of the bristles (4) forms loops (5) and another part (4*a*) stands out radially in a conventional manner.

3. A mascara brush according to claim 2, wherein sections which have loops (5) and sections with bristles (4) standing out radially are provided in the longitudinal direction.

4. A mascara brush according to claim 2, wherein sections which have loops (5) and sections with bristles (4) standing out radially are provided in the peripheral direction.

5. A mascara brush according to claim 2, wherein the radial length of the loops (5) differs from the length of the bristles (4) which stand out radially.

6. A mascara brush according to claim 1, wherein the loops (5) themselves are intertwisted, forming a figure-eight configuration.

7. A mascara brush according to claim 1, wherein the plane spanned by the loops (5) varies in inclination relative to the longitudinal axis defined by the intertwisted wire sections (1, 2).

8. A mascara brush for insertion into a reservoir of mascara and transfer of mascara to eyelashes of a user, the mascara brush having a plurality of bristles which are held between two intertwisted wire sections;

the bristles having means for transferring and holding mascara from a reservoir for application on eyelashes of a user;

wherein part of said means are loops (5) formed from at least part of the bristles which hold mascara within the area of the loops.

9. A mascara brush according to claim 8, wherein a part **(4*b*) of the bristles (4) forms loops (5) and another part (4*a*)** stands out radially in a conventional manner.

10. A mascara brush according to claim 9, wherein sections which have loops (5) and sections with bristles (4) standing out radially are provided in the longitudinal direction.

11. A mascara brush according to claim 9, wherein sections which have loops (5) and sections with bristles (4) standing out radially are provided in the peripheral direction.

12. A mascara brush according to claim 9, wherein the radial length of the loops (5) differs from the length of the bristles (4) which stand out radially.

13. A mascara brush according to claim 8, wherein the loops (5) themselves are intertwisted, forming for instance a figure-eight configuration.

* * * * *